US010655425B2

(12) United States Patent
Hofstee et al.

(10) Patent No.: US 10,655,425 B2
(45) Date of Patent: May 19, 2020

(54) METHOD AND SYSTEM FOR SEALING AN ANNULUR SPACE AROUND AN EXPANDED WELL TUBULAR

(71) Applicant: SHELL OIL COMPANY, Houston, TX (US)

(72) Inventors: Jelle Hofstee, Rijswijk (NL); Antonius Leonardus Maria Wubben, Rijswijk (NL); Djurre Hans Zijsling, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 208 days.

(21) Appl. No.: 15/740,197

(22) PCT Filed: Jul. 1, 2016

(86) PCT No.: PCT/EP2016/065484

§ 371 (c)(1),
(2) Date: Dec. 27, 2017

(87) PCT Pub. No.: WO2017/001653

PCT Pub. Date: Jan. 5, 2017

(65) Prior Publication Data

US 2018/0195363 A1 Jul. 12, 2018

(30) Foreign Application Priority Data

Jul. 1, 2015 (EP) ..... 15174872

(51) Int. Cl.

| | |
|---|---|
| ***E21B 33/128*** | (2006.01) |
| ***E21B 43/10*** | (2006.01) |
| ***E21B 33/12*** | (2006.01) |

(52) U.S. Cl.
CPC ..... *E21B 33/128* (2013.01); *E21B 33/1208* (2013.01); *E21B 43/103* (2013.01); *E21B 43/108* (2013.01)

(58) Field of Classification Search
CPC ..... E21B 23/01; E21B 23/06; E21B 33/1208; E21B 33/1216; E21B 33/128; E21B 2033/005; E21B 43/108; E21B 43/103
See application file for complete search history.

(56) References Cited

U.S. PATENT DOCUMENTS 3,422,902 A * 1/1969 Bouchillon ..... E21B 33/126 166/202
3,436,084 A * 4/1969 Courter ..... E21B 33/1216 277/338

(Continued)

FOREIGN PATENT DOCUMENTS

CA 2974332 A1 * 9/2016 ..... E21B 33/1216
WO 2012104257 A1 8/2012
WO WO-2017001653 A1 * 1/2017 ..... E21B 33/128

OTHER PUBLICATIONS

International Search Report and Written Opinion received for PCT Patent Application No. PCT/EP2016/065484, dated Sep. 9, 2016, 12 pages.

*Primary Examiner* — Jennifer H Gay

(57) ABSTRACT

An annular space surrounding an expandable well tubular (1) is sealed by: —a concave seal pusher assembly (5) with concave pusher elements comprising buckling joints (7) of which assembly (5) a first end is secured at a selected first location (2) of the outer surface of the unexpanded well tubular (1); —an annular elastomeric sealing ring (9) arranged with an inwardly tapered first end thereof against an outwardly tapered second end (8) of the concave seal pusher assembly (5); —a set of staggered and overlapping steel support strips (11) arranged around a second end of the (Continued)

sealing ring (9) and connected at one end thereof to a selected second location (3) of the outer surface of the unexpanded tubular (1); —expanding and thereby shortening the tubular (1) to push the inwardly tapered end of the sealing ring over the outwardly tapered end (8) of the seal pusher assembly (5) and buckling the staggered strips (11) against the outer surface (12) of the annular space surrounding the expanded tubular (1) to compress the sealing ring (9) and seal off the annular space.

13 Claims, 2 Drawing Sheets

(56) References Cited

U.S. PATENT DOCUMENTS 3,587,736 A 6/1971 Brown
5,010,958 A 4/1991 Meek et al.
5,678,635 A 10/1997 Dunlap et al.
6,959,759 B2 * 11/2005 Doane ..... E21B 23/06 166/134
7,004,260 B2 * 2/2006 Bosma ..... E21B 43/103 166/387
7,216,706 B2 * 5/2007 Echols ..... E21B 33/12 166/285
7,341,110 B2 * 3/2008 Doane ..... E21B 23/06 166/387
7,431,078 B2 * 10/2008 Carmody ..... E21B 23/06 166/118
7,661,471 B2 * 2/2010 Murray ..... E21B 33/1216 166/179
8,151,873 B1 * 4/2012 Lee ..... E21B 33/1208 166/118
8,651,178 B2 * 2/2014 Mercer ..... E21B 23/06 166/121
8,662,161 B2 * 3/2014 Lee ..... E21B 33/1208 166/118
8,678,099 B2 * 3/2014 McLeod ..... E21B 33/1293 166/387
8,678,350 B2 * 3/2014 Coull ..... E21B 34/12 137/601.03
8,997,857 B2 * 4/2015 Wubben ..... E21B 23/01 166/207
9,140,094 B2 * 9/2015 Lee ..... E21B 33/1208
9,284,813 B2 * 3/2016 Porta ..... E21B 33/1208
9,523,256 B2 * 12/2016 Bilansky ..... E21B 33/1216
9,752,400 B2 * 9/2017 Hazelip ..... E21B 33/0422
9,903,175 B2 * 2/2018 Atkins ..... E21B 33/1208
2003/0116328 A1 * 6/2003 Doane ..... E21B 23/06 166/387
2003/0141079 A1 * 7/2003 Doane ..... E21B 23/06 166/387
2004/0055758 A1 * 3/2004 Brezinski ..... E21B 33/12 166/384
2004/0069502 A1 * 4/2004 Luke ..... E21B 33/1208 166/387
2004/0182582 A1 * 9/2004 Bosma ..... E21B 43/103 166/387
2004/0256115 A1 * 12/2004 Vincent ..... E21B 43/103 166/387
2005/0023003 A1 * 2/2005 Echols ..... E21B 33/12 166/384
2007/0125532 A1 * 6/2007 Murray ..... E21B 33/1216 166/179
2009/0308592 A1 * 12/2009 Mercer ..... E21B 23/06 166/134
2010/0276137 A1 * 11/2010 Nutley ..... E21B 33/1208 166/185
2012/0133098 A1 * 5/2012 Farquhar ..... E21B 33/128 277/314
2012/0217003 A1 * 8/2012 Yee ..... E21B 33/1208 166/129
2012/0217004 A1 * 8/2012 Yee ..... E21B 33/1208 166/129
2013/0306331 A1 * 11/2013 Bishop ..... E21B 33/128 166/387
2014/0262351 A1 * 9/2014 Derby ..... E21B 33/1216 166/387
2014/0361497 A1 * 12/2014 Porta ..... E21B 33/1208 277/619
2015/0308214 A1 * 10/2015 Bilansky ..... E21B 33/1216 166/387
2015/0330174 A1 * 11/2015 Craigon ..... E21B 33/1208 166/305.1
2016/0090801 A1 * 3/2016 Hazelip ..... E21B 33/0422 166/382
2016/0090813 A1 * 3/2016 Conner ..... E21B 33/1216 166/387
2017/0101846 A1 * 4/2017 Vasques ..... E21B 33/1208
2017/0130552 A1 * 5/2017 Moyes ..... E21B 33/128
2018/0195363 A1 * 7/2018 Hofstee ..... E21B 33/128
2019/0120011 A1 * 4/2019 Kellner ..... E21B 33/128
2019/0128089 A1 * 5/2019 Guerra ..... E21B 33/1216

* cited by examiner

Fig. 3
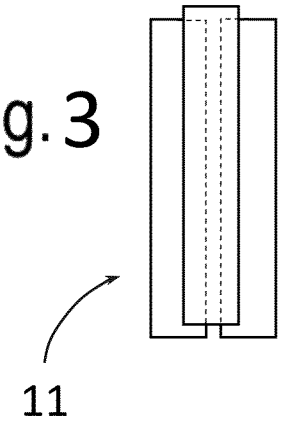
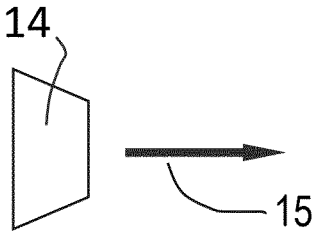
Fig. 4

METHOD AND SYSTEM FOR SEALING AN ANNULUR SPACE AROUND AN EXPANDED WELL TUBULAR

CROSS REFERENCE TO EARLIER APPLICATIONS

This is a National phase application of International Application PCT/EP2016/065484, filed 1 Jul. 2016, which claims priority of European application 15174872.0, filed 1 Jul. 2015.

FIELD OF THE INVENTION

The invention relates to a method and system for sealing an annular space around an expanded well tubular.

BACKGROUND OF THE INVENTION

A tubular expansion system and method are disclosed in US patent application No. 2013/312954 A. A well tubular is expanded by pulling an expansion cone therethrough and the outer surface of the well tubular comprises sealing rings for sealing the remaining annular space between the expanded well tubular and surrounding formation, which seals may leak if the wellbore has an irregular inner surface.

Downhole annular sealing systems are described in U.S. Pat. No. 3,857,736 and US patent application US2004/0182582, which sealing systems can only seal an annular space with a limited width.

There is a need to provide an improved annular seal around the bottom of an expandable liner which is activated by the expansion process and seals the annulus between the open hole and the expanded liner to prevent U-tubing of the liquid cement during expansion of the liner even if the wellbore has an irregular inner surface and/or in a wide annular space.

SUMMARY OF THE INVENTION

In accordance with the invention there is provided a method for sealing an annular space surrounding an expandable well tubular, the method comprising:

- securing a first end of a seal pusher assembly at a selected first location of the outer surface of the unexpanded well tubular;
- arranging an annular elastomeric sealing ring with an inwardly tapered first end thereof against an outwardly tapered second end of the seal pusher assembly;
- arranging a set of staggered strips, which at least partially overlap each other, around a second end of the sealing ring;
- connecting each of the staggered strips at one end thereof to a selected second location of outer surface of the unexpanded tubular adjacent to the second end of the sealing ring;
- expanding the tubular, thereby shortening an axial distance between the selected first and second locations and inducing the outwardly tapered end of the sealing ring to slide over the inwardly tapered end of the seal pusher assembly and the staggered strips to expand against the inner surface of the annular space surrounding the tubular and to lock and further push the outwardly tapered end of the sealing ring over the seal pusher assembly and thereby compress the sealing ring and seal the annular space; and

- wherein the seal pusher assembly comprises a support ring that engages the first shoulder and a series of concave pusher segments that are at one end thereof pivotally connected to the support ring and at another end thereof form the outwardly tapered end of the seal pusher assembly, which concave pusher elements comprise buckling joints that are buckled and thereby expand the sealing ring against the inner surface of the annular space surrounding the expanded tubular.

In accordance with the invention there is furthermore provided a system for sealing an annular space surrounding an expandable well tubular, the system comprising:

- a seal pusher assembly of which a first end is secured at a selected first location of the outer surface of the unexpanded well tubular;
- an annular elastomeric sealing ring arranged with an inwardly tapered first end thereof against an outwardly tapered second end of the seal pusher assembly;
- a set of staggered strips, which at least partially overlap each other arranged around a second end of the sealing ring;
- means for connecting each of the staggered strips at one end thereof to a selected second location of outer surface of the unexpanded tubular adjacent to the second end of the sealing ring;
- means for expanding the tubular, thereby shortening an axial distance between the selected first and second locations and inducing the outwardly tapered end of the sealing ring to slide over the inwardly tapered end of the seal pusher assembly and the staggered strips to expand against the outer surface of the annular space surrounding the tubular and to lock and further push the outwardly tapered end of the sealing ring over the seal pusher assembly and thereby compress the sealing ring and seal the annular space; and
- wherein the seal pusher assembly comprises a support ring that engages the first shoulder and a series of concave pusher segments that are at one end thereof pivotally connected to the support ring and at another end thereof form the outwardly tapered end of the seal pusher assembly, which concave pusher elements comprise buckling joints that are buckled and thereby expand the sealing ring against the inner surface of the annular space surrounding the expanded tubular.

The system may furthermore comprise first and second support shoulders that are welded around the unexpanded tubular at the first and second locations between which the seal pusher assembly, sealing ring and staggered strips are arranged and the seal pusher assembly may comprise a support ring that engages the first shoulder and a series of concave pusher segments that are at one end thereof pivotally connected to the support ring and at another end thereof form the outwardly tapered end of the seal pusher assembly, which concave pusher elements are configured to be buckled and thereby expand the sealing ring against the outer surface of the annular space surrounding the expanded tubular.

Each of the staggered strips may at one end thereof be pivotally connected to the second support shoulder adjacent to and around the second end of the sealing ring and may be configured to be buckled when its free end is expanded against the outer surface of the annular space surrounding the expanded tubular and to preserve the overlap between the buckled expanded staggered strips.

It will be understand that in an open, uncased, borehole section the outer surface of the annular space is formed by the borehole wall, and that in a cased borehole the annular space is formed by a the inner wall of a previously set casing section surrounding the annular space.

These and other features, embodiments and advantages of the expansion method and tool according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

BRIEF DESCRIPTION OF THE DRAWINGS

FIG. 3 is a schematic diagram illustrating staggered strips according to the invention.

FIG. 4 is a schematic diagram illustrating an expander cone according to the invention.

DETAILED DESCRIPTION OF THE DEPICTED EMBODIMENTS

FIGS. 1 and 2A-C show an annular seal assembly which is mounted on an expandable liner (1). The seal is activated by the liner expansion process and makes use of the shortening of the liner while the expansion cone is passing through the seal assembly in an expansion direction.

Figure 1:
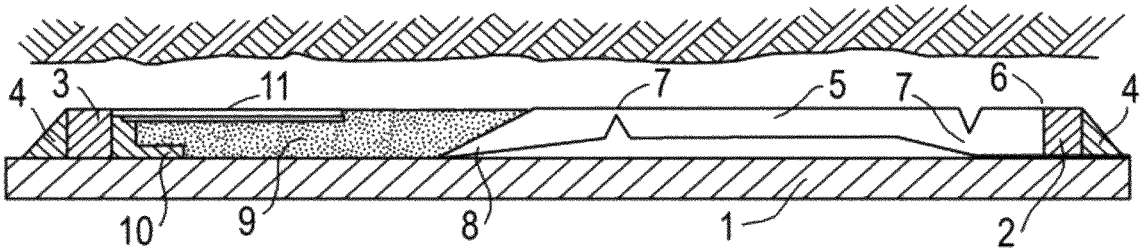
FIGS. 1 and 2A-2C are schematic longitudinal sectional views of an annular seal.

As an example, the description below is given of a possible embodiment shown in FIGS. 1 and 2A-C. FIG. 1 shows components of the annular seal.

The annular seal comprises two axially spaced support shoulders provided by first and second weld rings (2) and (3), which are welded to the liner (1) by welds (4) that provide 360 degrees circumferential coverage. A set of circumferentially spaced pusher segments (5) is regularly spaced over the circumference of the liner (1) and spot-welded to the first weld ring (2) at positions (6). The total number of pusher segments may be 24 over the circumference of the liner. The pusher segments are provided with two plastic hinges (7) to facilitate the activation process during expansion. The inner surface of the pusher segments is concave to facilitate contact between the sharp nose (8) of the segments and the liner, while the cone is bending and straightening the pipe during expansion. An elastomer ring-shaped seal (9) is provided around the liner in between the weld ring (3) and the sharp nose (8) of the pusher segments. The elastomer may be vulcanized to the second weld ring (3) over the full circumference of the liner/weld ring at location (10). Two staggered layers of thin-walled strips (11) are overlaying the elastomer. One end of the strips is welded to the shoulders of the second weld ring (3). The number of inner strips and outer strips may be equal to the number of pusher segments. The overlap between the inner layer and the outer layer of strips is such that after expansion of the liner the layers are still overlapping and thus provide effective support to the elastomer. A side view on a few of the staggered strips (11), which partially overlap each other, is shown in FIG. 3.

Figure 2A:
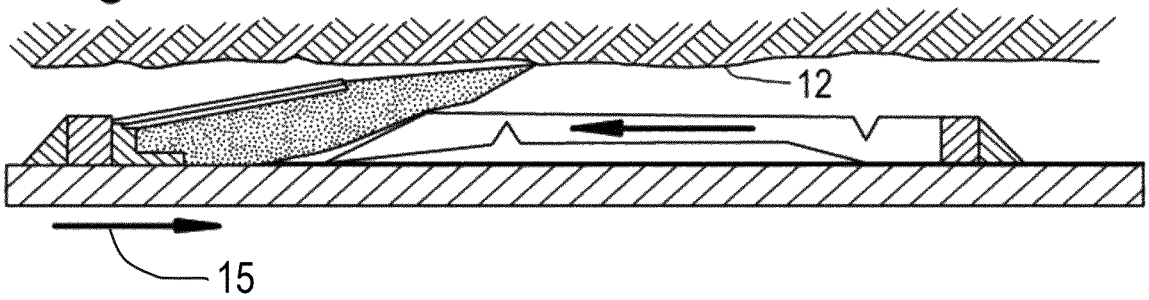

FIG. 4 shows an expansion cone 14 moving in the expansion direction 15 as indicated in FIG. 2*a*. When the cone passes the annular seal the liner section concerned will shorten i.e.: the axial distance between the first and second weld rings (2) and (3) will reduce. Setting of the annular seal is shown in FIGS. 2*a* to 2*c*.

As a result of this the pusher segments will slide over the liner surface and move in the direction of weld ring (3) (FIG. 2 *a*). The movement of the pusher segments is shown in FIG. 2*a*.

Thereby the ring-shaped elastomer seal is pushed over the sharp nose of the segments toward the wall of the open hole (12). The thin-walled strips (11) will bend outwards with the elastomer.

Figure 2B:
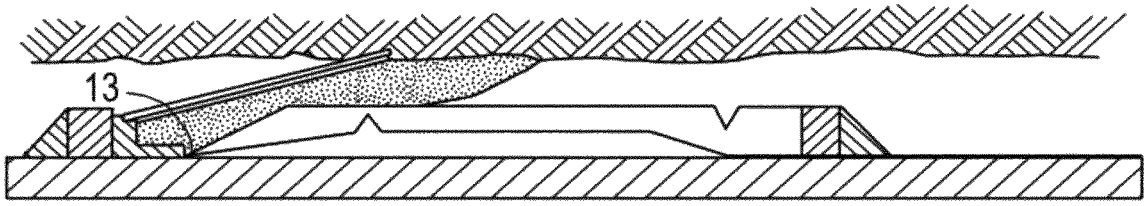
Figure 2C:
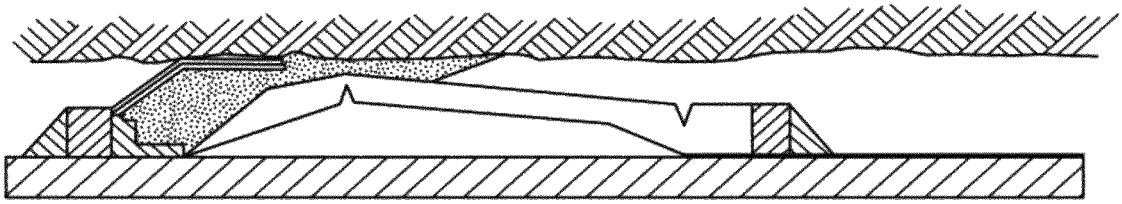

Upon further shortening of the liner the pusher segments will push all the elastomer that was initially in contact with the liner over the sharp nose of the segments towards the wall of the hole (FIG. 2*b*). The pusher segments will contact the upper edge (13) of the weld ring (3) and reach the end of their stroke as illustrated in FIG. 2*b*. At this stage the elastomer and the upper part of the thin-walled strips may be pressed against the wall of the hole e.g. in case of a gauge hole size. At this stage the ring-shaped elastomer will form a liquid tight self-energizing seal against the wall of the hole, whereby the thin-walled strips provide support to the elastomer to mitigate extrusion of the elastomer at high annular pressure acting on the elastomer in the direction from weld ring (2) to weld ring (3).

During expansion of the remainder of the liner section between the weld rings a tensile force will build up in the liner which may stop further shortening over this liner section.

However, in case there is still room for further radial movement of the elastomer, the axial compression force in the pusher segments will cause the pusher segments to bend at the plastic hinges (7) (FIG. 2 *c*). FIG. 2*c* shows how the pusher segments may buckle.

In this way the sharp nose section of the pusher segments will rotate about the contact point (13) between the nose and the edge of the weld ring (3) thereby pushing the elastomer further radially outward until the wall of the open hole provides resistance so that also a liquid tight seal can be formed in an overgauge hole. The dimensions of the pusher segments can be designed such that the hole size in which sealing can be achieved is maximized.

Accordingly an irregularly shaped annular space surrounding an expandable well tubular (1) can be adequately sealed by providing the system with:

- a seal pusher assembly (5) of which a first end is secured at a selected first location (2) of the outer surface of the unexpanded well tubular (1);
- an annular elastomeric sealing ring (9) arranged with an inwardly tapered first end thereof against an outwardly tapered second end (8) of the seal pusher assembly (5);
- a set of staggered and overlapping support strips (11) arranged around a second end of the sealing ring (9) and connected at one end thereof to a selected second location (3) of the outer surface of the unexpanded tubular (1) adjacent to the second end of the sealing ring.

The system may be deployed by expanding and thereby shortening the tubular (1), thereby also pushing the inwardly tapered end of the sealing ring to slide over the outwardly tapered end (8) of the seal pusher assembly (5) and expanding the staggered strips (11) against the outer surface (12) of the annular space surrounding the expanded tubular (1) to further compress the sealing ring (9) and adequately seal off the potentially irregularly shaped annular space.

Therefore, the method, system and/or any products according to present invention are well adapted to attain the ends and advantages mentioned as well as those that are inherent therein.

The particular embodiments disclosed above are illustrative only, as the present invention may be modified, combined and/or practiced in different but equivalent manners apparent to those skilled in the art having the benefit of the teachings herein.

Furthermore, no limitations are intended to the details of construction or design herein shown, other than as described in the claims below.

It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist of" the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

The invention claimed is:

1. A method for sealing an annular space surrounding an expandable well tubular, the method comprising:

securing a first end of a seal pusher assembly at a selected first location of an outer surface of an unexpanded well tubular;

arranging an annular elastomeric sealing ring with an inwardly tapered first end thereof against an outwardly tapered second end of the seal pusher assembly;

arranging a set of staggered strips, which at least partially overlap each other, around a second end of the sealing ring;

connecting each of the staggered strips at one end thereof to a selected second location of the outer surface of the unexpanded tubular adjacent to the second end of the sealing ring;

obtaining an expanded tubular by expanding the unexpanded tubular, thereby shortening an axial distance between the selected first and second locations and inducing the inwardly tapered end of the sealing ring to slide over the outwardly tapered end of the seal pusher assembly and the staggered strips to expand against an outer surface of the annular space surrounding the tubular and to lock and further push the inwardly tapered end of the sealing ring over the seal pusher assembly and thereby compress the sealing ring and seal the annular space; and wherein the seal pusher assembly comprises a support ring that engages a first support shoulder and a series of concave pusher segments that are at one end thereof pivotally connected to the support ring and at another end thereof form the outwardly tapered end of the seal pusher assembly, which concave pusher elements comprise buckling joints that are buckled and thereby expand the sealing ring against an inner surface of the annular space surrounding the expanded tubular.

2. The method of claim 1, wherein the first support shoulder and a second support shoulder are welded around the unexpanded tubular at the first and second locations between which the seal pusher assembly, sealing ring and staggered strips are arranged.

3. The method of claim 1, wherein each of the staggered strips is at one end thereof pivotally connected to a second support shoulder adjacent to and around the second end of the sealing ring.

4. The method of claim 3, wherein each of the staggered strips includes a free end, and wherein each of the staggered strips is buckled when its corresponding the free end is expanded against the outer surface of the annular space surrounding the expanded tubular and the overlap between the buckled expanded staggered strips is maintained.

5. A system for sealing an annular space surrounding an expandable well tubular, the system comprising:

a seal pusher assembly of which a first end is secured at a selected first location of an outer surface of an unexpanded well tubular;

an annular elastomeric sealing ring arranged with an inwardly tapered first end thereof against an outwardly tapered second end of the seal pusher assembly;

a set of staggered strips, which at least partially overlap each other, arranged around a second end of the sealing ring;

a connection between the staggered strips at one end thereof and a selected second location of the outer surface of the unexpanded tubular adjacent to the second end of the sealing ring;

an expander for expanding the tubular, thereby shortening an axial distance between the selected first and second locations and inducing the inwardly tapered end of the sealing ring to slide over the outwardly tapered end of the seal pusher assembly and the staggered strips to expand against an outer surface of the annular space surrounding the tubular and to lock and further push the inwardly tapered end of the sealing ring over the seal pusher assembly and thereby compress the sealing ring and seal the annular space; and wherein the seal pusher assembly comprises a support ring that engages a first support shoulder and a series of concave pusher segments that are at one end thereof pivotally connected to the support ring and at another end thereof form the inwardly tapered end of the seal pusher assembly, which concave pusher elements comprise buckling joints that are configured to be buckled and thereby expand the sealing ring against the outer surface of the annular space.

6. The system of claim 5, wherein the first support shoulder and a second support shoulder are welded around the unexpanded tubular at the first and second locations between which the seal pusher assembly, sealing ring and staggered strips are arranged.

7. The system of claim 5, wherein each of the staggered strips is at one end thereof pivotally connected to a second support shoulder adjacent to and around the second end of the sealing ring.

8. The system of claim 7, wherein each of the staggered strips includes a free end, and wherein each of the staggered strips is configured to be buckled when the free end is expanded against the outer surface of the annular space and to preserve the overlap between the buckled expanded staggered strips.

9. A system for sealing an annular space surrounding an expandable well tubular, the system comprising:

a seal pusher assembly of which a first end is secured at a selected first location of an outer surface of an unexpanded well tubular;

an annular elastomeric sealing ring arranged with an inwardly tapered first end thereof against an outwardly tapered second end of the seal pusher assembly;

a set of staggered and overlapping support strips arranged around a second end of the sealing ring and connected at one end thereof to a selected second location of the outer surface of the unexpanded tubular adjacent to the second end of the sealing ring, wherein the seal pusher assembly further comprises a support ring that engages a first support shoulder and a series of concave pusher segments that are at one end thereof pivotally connected to the support ring and at another end thereof form the inwardly tapered end of the seal pusher assembly, which concave pusher elements comprise buckling joints that are configured to be buckled and thereby expand the sealing ring against an outer surface of the annular space.

10. The system of claim 9, wherein the sealing ring is compressible to seal the annular space by shortening of an axial distance between the selected first and second locations and inducing the inwardly tapered end of the seal pusher assembly and the staggered and overlapping support strips to expand against the outer surface of the annular space.

11. The system of claim 9, wherein the first support shoulder and a second support shoulder are welded around the unexpanded tubular at the first and second locations between which the seal pusher assembly, sealing ring and staggered support strips are arranged.

12. The system of claim 9, wherein each of the staggered support strips is at one end thereof pivotally connected to a second support shoulder adjacent to and around the second end of the sealing ring.

13. The system of claim 12, wherein each of the staggered support strips has a free end, and wherein each of the staggered strips is configured to be buckled when the free end is expanded against the outer surface of the annular space and to preserve the overlap between the buckled expanded staggered strips.

* * * * *